US006092573A

United States Patent [19]

Zaiser

[11] Patent Number: 6,092,573

[45] Date of Patent: Jul. 25, 2000

[54] PLANE HEAD FOR A PLANING MACHINE

[75] Inventor: Adolf Zaiser, Koengen, Germany

[73] Assignee: Robert Bosch GmbH, Stuttgart, Germany

[21] Appl. No.: 09/321,348

[22] Filed: May 27, 1999

[51] Int. Cl.[7] ..... B27C 1/00

[52] U.S. Cl. ..... 144/230; 144/114.1; 144/241; 144/218; 407/41; 407/49

[58] Field of Search ..... 30/382, 475, 478; 144/114.1, 117.1, 218, 230, 241; 407/32, 41, 49, 51, 80, 91, 107, 108

[56] References Cited

U.S. PATENT DOCUMENTS

| | | | |
|---|---|---|---|
| 3,199,799 | 8/1965 | Sybertz | 144/230 |
| 4,610,285 | 9/1986 | Derivaz | 144/230 |
| 4,907,631 | 3/1990 | Krautzberger | 407/49 |
| 5,133,394 | 7/1992 | Landtwing | 144/230 |
| 5,904,193 | 5/1999 | Kellner | 144/230 |

FOREIGN PATENT DOCUMENTS

| | | |
|---|---|---|
| 195 36 559 A1 | 4/1997 | Germany . |
| 682470 | 9/1993 | Switzerland . |

*Primary Examiner*—W. Donald Bray
*Attorney, Agent, or Firm*—Michael J. Striker

[57] ABSTRACT

The plane head for the hand-held planing machine includes a cylindrical base body (11) made from a group of identical stamped sheets (18) arranged axially next to each other and each provided with a punched hole (150) so as to form a base body cavity (15); a planing knife (14) protruding radially beyond an outer surface of the base body (11) from a longitudinal groove (13) and fixed therein by a form-fitting connection or form-locking connection so that the planing knife cannot be radially dislodged from the base body; and a chuck wedge (16) received in the base body cavity (15) so that the planing knife (14) is clamped in the base body (11) by centrifugal force during rotation of the plane head. To provide strength and safety from action of wood chips the chuck wedge (16) is held releasably, radially movable, in the base body cavity (15), the base body cavity (15) and the chuck wedge (16) are shaped to conform to each other so that the chuck wedge bears with a clamping surface (161) on the planing knife (14) and is braced on opposing surfaces of the base body cavity (15) facing opposite to each other in a rotation direction of the planing head. The chuck wedge (16) is formed so that it is clampable against a bottom surface (152) of the base body cavity (15) to produce a spring force acting on the planing knife.

12 Claims, 4 Drawing Sheets

PLANE HEAD FOR A PLANING MACHINE

BACKGROUND OF THE INVENTION

1. Field of the Invention

The present invention relates to a head of a plane or planing machine and, more particularly, to a plane head, which comprises a cylindrical base body including a plurality of stamped sheets arranged next to each other axially, a planing knife protruding radially beyond the surface of the base body from at least one longitudinal groove in the base body and fixed in the base body by a form-fitting connection or form-locking connection so that it cannot be radially dislodged or moved and at least one chuck wedge, which is received inside of a base body cavity formed by punched holes in the stamped sheets, whereby the planing knife is clamped in the base body by a centrifugal force during rotation of the plane head.

2. Prior Art

The known plane head of this kind, also called a knife carrier or planing shaft, described, for example, in German Patent Document DE 195 36 559 A1. This plane head is rotatably mounted in the housing of a hand-held planing machine driven by an electric motor. The chuck wedge is held non-releasably by only a spring (i.e. it cannot be dissembled without destroying the arrangement) inside of a cavity or recess in the base body of the plane head fixed elastically in it. This spring exerts a tension force on the planing knife, which is arranged in a longitudinal groove provided in the plane head when the plane head is idle, which prevents the planing knife from slipping out of the plane head. On rotation of the plane head the chuck wedge is forced outwardly, whereby its pressing force on the planing knife increases. A gripping slot formed in the chuck wedge, which cooperates with a projection formed on the base body, limits the radial motion of the chuck wedge toward the inside and toward the outside. The base body is formed by a punched packet of substantially identically shaped disks or identically shaped sheets, which are nonrotatably mounted on a plane head shaft and are axially clamped with each other by clamping bodies bearing on the shaft. A chuck wedge element and a leaf spring element are formed in each shaped sheet, so that the chuck wedge with a leaf spring attached elastically to the base body and with the chuck wedge result.

A similar planing head is known from European Patent Document EP 0 117 991 B1. The planing knife with a positioning groove formed in the knife front section engages a positioning stud extending axially, projecting into the groove side of the longitudinal groove. The positioning stud cooperates with the positioning groove to only prevent the planing knife from slipping out radially from the longitudinal groove. However radial play is provided which allows radial adjustment of the planing knife. A self-clamping chuck wedge with a small wedge angle of about 4 to 5° forms the groove side bearing on the back of the planing knife and braces itself in the base body cavity or recess. For reliable self-clamping the chuck wedge must be made with a high degree of accuracy, which requires milling or grinding of the wedge pressing surfaces. The clamping of the planing knife occurs by brief activation of the hand-held planing machine, so that the planing knife is fixed in position by the self-chucking or self-clamping chuck wedge. For knife removal the chuck wedge must be given an inwardly directed blow with a hammer and soft metal piece so that it can then be withdrawn laterally with the knife from the longitudinal groove.

SUMMARY OF THE INVENTION

It is an object of the present invention to provide an improved planing head for a planing machine of the above-described kind.

This object, and others which will be made more apparent hereinafter, are attained in a head of a planing device, which comprises a cylindrical base body including a plurality of stamped sheets arranged next to each other axially, a planing knife protruding radially beyond the surface of the base body and fixed in the base body so that it cannot be radially dislodged or moved by a form-locking connection device and at least one chuck wedge, which is received inside of a base body cavity formed by punched holes in the stamped sheets, whereby the planing knife is clamped in the base body by a chucking force.

According to the invention the chuck wedge is held releasably, radially movable, in the base body cavity, the shape of the base body cavity and the chuck wedge are conformed to each other so that the chuck wedge bearing with a clamping surface on the planing knife is braced on surfaces of the base body cavity facing opposite to each other in a rotation direction of the planing head and the chuck wedge is pressed against the bottom of the base body cavity to produce a spring force acting on the planing knife.

The plane head with the features of the invention has the advantage that its rigidity and safety from wood cuttings that are driven or caught in it is substantially increased in contrast to the planing head of the prior art described above, in which the planing knife similarly is fixed by a form-fitting connection against radial displacement. This is important for easy knife replacement or exchange. Wood cuttings that jam the chuck wedge and thus prevent knife exchange can be much more easily removed in the case of the plane head according to the invention. Furthermore with the chuck wedge held releasably without possibility of loss a reduced groove height suffices for knife replacement, since no lateral pin key needs to be inserted to release the knife and no space needs to be provided for that.

In contrast to the prior art plane head with the self-clamping chuck wedge the plane head according to the invention has the advantage that knife replacement requires much less effort. The larger wedge angle for the chuck wedge according to the invention allows greater tolerances and thus the use of an economical drawn steel section for the chuck wedge.

Various preferred embodiments are described hereinbelow and in the claims appended below.

According to a preferred embodiment of the invention the radial form-locking connection device for connecting the planing knife to the base body comprises a molded stud that extends axially on the groove side of the longitudinal groove formed by the base body and a corresponding stud groove, that extends axially on the back or rear of the knife in the same way.

According to an advantageous embodiment of the invention the chuck wedge is secured in the base body cavity from radial release during knife replacement by a securing device, so that it cannot be lost. In an advantageous manner the radial securing device comprises an axially protruding catch element extending into the base body cavity and a catch groove extending axially in the chuck wedge, in which the catch element engages with sufficient radial play.

According to a preferred embodiment of the invention the chuck wedge is held releasably in the base body cavity, axially slidable between outer cover sheets on the ends of the base body. Preferably one cover sheet is completely flat in the vicinity of the punched cavity in the remaining stamped sheets and the other stamped sheet has a chuck wedge window in the vicinity of the punched cavity or hole. The chuck wedge window is formed so that the chuck wedge can pass through it when it bears on the bottom of the base body cavity. The chuck wedge can be axially pushed out of the base body cavity axially through this chuck body window after complete release of the knife tension or clamping by rotating back the set or clamping screws. Alternatively the chuck body window may be eliminated when the cover sheet is put on the sheet packet and then is welded to it after insertion of the chuck wedge.

According to an advantageous embodiment of the invention a lock sheet with a lock spring formed in one piece with it is inserted between stamped sheets, preferably next to a cover sheet. The lock spring bears with a pressing side with a spring force on the planing knife in the longitudinal groove and engages with a lock stud protruding on the pressing surface in a corresponding depression in the front section of the planing knife. Because of this lock spring the planing knife is automatically guided into an ideal position during insertion of the planing knife and is reliable secured in position. Alternatively the cover sheet provided with the chuck wedge window is formed as a lock sheet, when the radial boundary of the chuck wedge window is formed by this lock spring.

In another advantageous embodiment of the planing head according to the invention a lock sheet and a lock spring are arranged together between sheets of the base body. In this embodiment the lock spring has a pressing side and a lock element protruding from the pressing side, the lock spring bears with its pressing side with a spring force on the planing knife inserted in the longitudinal groove and the lock spring engages with the lock element in a depression provided in a front section of the planing knife. The lock spring is advantageously made from spring steel, light metal or plastic and the lock spring is held end-wise in the longitudinal groove punched in the stamped sheets. This latter embodiment has the advantage that the lock spring can be made of higher quality material, e.g. from tempered spring steel with good spring properties, and all these sheets can be made with economical 'punch or stamp friendly' materials by separate manufacture of the lock spring and its subsequent insertion in the receiving groove provided in the lock sheet. Only one more punch station is required to make the lock sheet, in which the at least one receiving groove is provided in the standard fabricated stamped sheet and after that the lock spring is pressed into the receiving groove. The lock spring to be inserted can be cut by means of a laser or fine punched. An economical lock sheet is obtained for axially securing the planing knife with improved lock spring tension for a more exact knife positioning and convenient knife exchange or replacement.

According to various embodiments of the invention the lock spring can be secured in the at least one receiving groove by nonrotatable or rotatable clamping of one lock spring end while the other lock spring end is free or bears on one of the surfaces facing opposite from each other in the rotation direction of the plane head. However both ends of the lock spring can however be inserted in respective receiving grooves so that the spring ends are longitudinally slidable in the receiving groove, whereby the pressing surface formed on the lock spring can be displaced linearly or nonlinearly relative to the planing knife to fix the planing knife in the longitudinal groove. Also narrow slots, otherwise not punchable, can be cut into the lock spring in connection with the punched holes, which are suitable for different purposes. Also one cover sheet can be provided with a lock spring to avoid the necessity of providing a separate lock spring.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
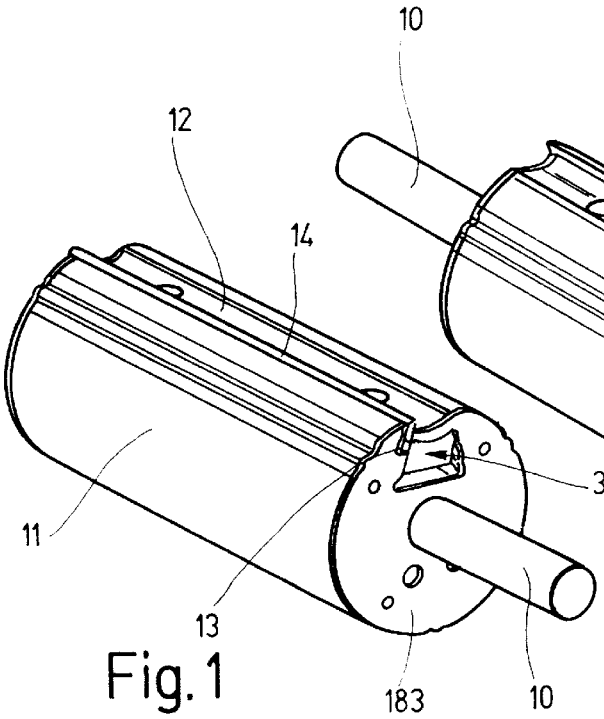
FIGS. 1 and 2 are perspective views of a plane head for a hand-held planing machine according to the invention from opposite sides.
Figure 2:
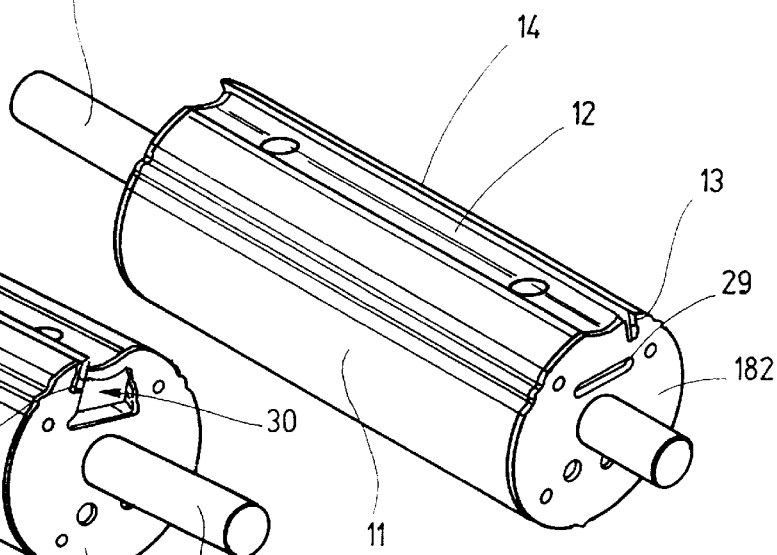

The plane head shown in perspective from different sides in FIGS. 1 and 2 has a cylindrical base body 11 having a substantially circular outer contour, in which a chuck groove 12 and a longitudinal groove 13 for receipt of a planing knife 14 are provided. The planing knife 14 is clamped by means of a chuck wedge 16 held releasably in a base body cavity. The base body 11 is nonrotatably mounted on a shaft 10, which is received with both of its ends protruding from the opposite ends of the base body 11 in rotating bearings in the housing of the hand-held planing machine. The one end of the shaft 10 is coupled with an electric motor by means of a gear device. The chuck wedge 16 is forced radially outward in the rotating plane head, whereby its pressing force on the plane knife increases.

Figure 5:
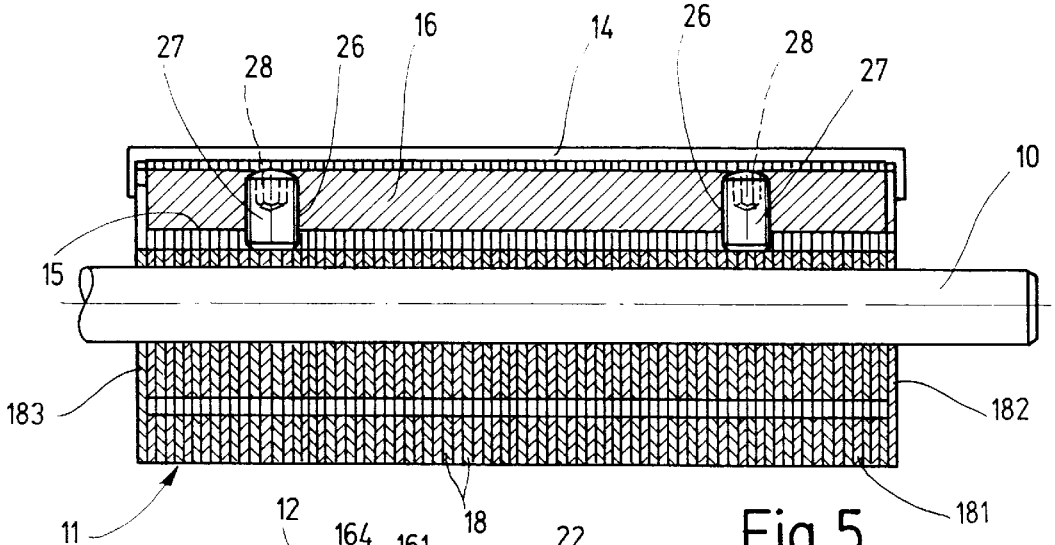
FIG. 5 is a longitudinal cross-sectional view through the plane head taken along section line V—V in FIG. 3.

As shown in FIG. 5, the base body 11 is made from a punched packet with a plurality of standard equally shaped sheets 18 axially spaced from each other. These shaped sheets 18 are punched, packeted and welded, so that they are nonrotatably fixed to each other. The entire sheet packet forming the base body 11 is rotatably fixed on the shaft 10. All shaped sheets 18 are shaped the same with the exception of both outer cover sheets 182,183 on the ends of the base body 11 and have the cross-section shown in FIG. 6. All shaped sheets 18 have a central hole 19 for sliding them on the shaft 10, two hollow cavities 20,21, for weight reduction and a cavity or recess 150, whereby the longitudinal groove-like base body cavity 15 (FIG. 5) results from assembly of the shaped sheets 18 next to each other. The chuck wedge 16 arranged releasably in the base body cavity 15, which is formed from a drawn steel section with a wedge angle of about 25° to 45°, has a clamping surface 161 (FIG. 6) for clamping the planing knife 14, which forms the one groove side of the longitudinal groove 13. The other groove side of the longitudinal groove 13 is formed by a plurality of radially outwardly extending punched edges 151 formed on the shaped sheets 18 adjacent to the recess 150.

The planing knife 14 is secured in a radial position by means of a form-locking connection to the base body 11. The form-locking connection is provided by molded stud 22 projecting from the punched edges 151 of the respective shaped sheets 18 into the recess or cavity 150 (FIG. 6) and a suitable stud slot or stud groove 23 (FIGS. 3 and 4) provided in the back of the planing knife 14.

The chuck wedge 16 resting releasably in the base body cavity 15 is secured to prevent it from falling out radially from the base body cavity when the planing knife 14 is not present, for example during knife exchange. This is guaranteed because an axially extending catch element 25 projecting from the base body 11 into the base body cavity 15 engages in a punched catch groove 24 of the chuck wedge with considerable radial play.

Figure 3:
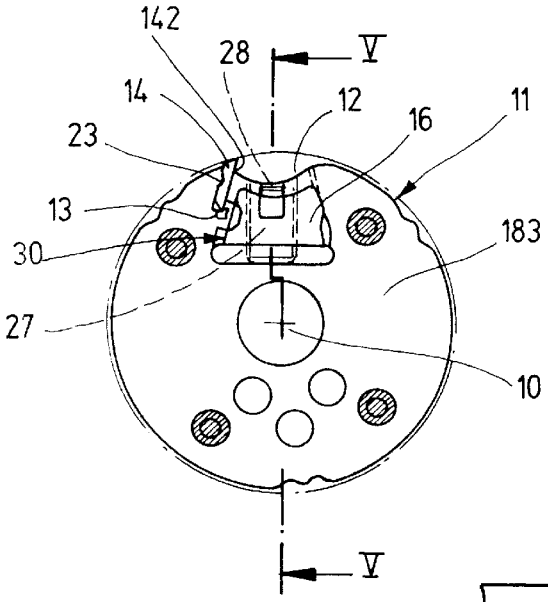
FIG. 3 is a front view of the plane head shown in FIG. 1.
Figure 4:
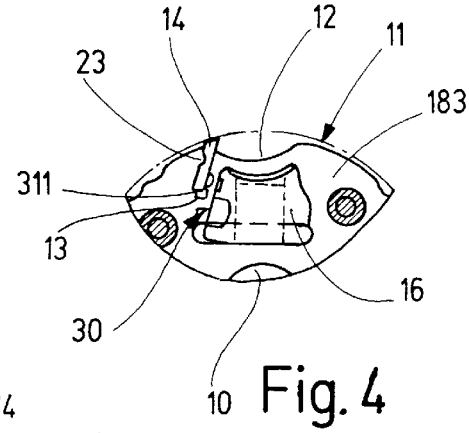
FIG. 4 is a detailed view of the same device as shown in FIG. 3 with the chuck wedge in its mounted position.
Figure 6:
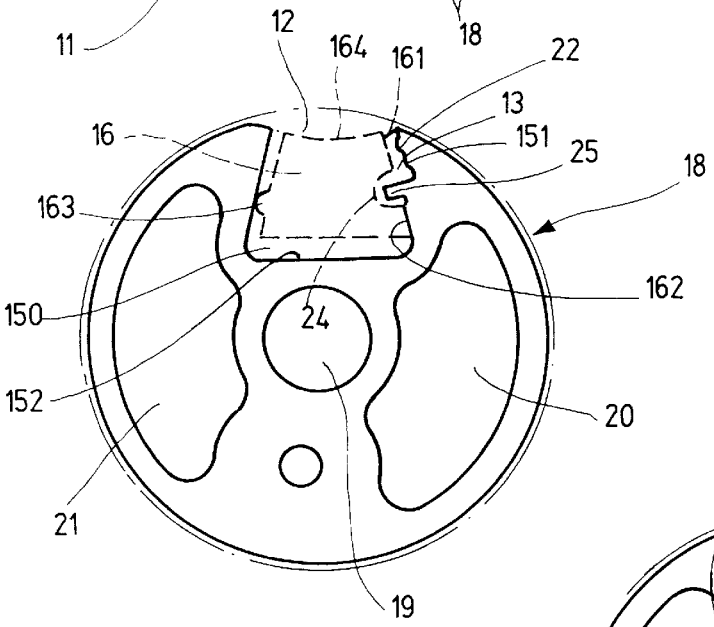
FIG. 6 is a plan view of various embodiments of punched or stamped sheets of the plane head shown in FIGS. 1 to 5 with the chuck wedge shown with dashed lines.

As clearly indicated in FIG. 6, FIGS. 3 and 4 also show that the surfaces of the base body cavity 15 or the recess 150 facing opposite to each other in the rotation direction in the individual shaped sheets 18 and outer cover sheets 182,183 are inclined so that they point toward each other in a radially outward-pointing direction to form a wedge-shaped or trapezoidal cross-sectioned cavity. The chuck wedge 16 has a clamping surface 161 for the planing knife 14 on its side bearing on the plane bearing surface 162 and a convex longitudinal rib 163 on its side facing away from that side, with which the chuck wedge 16 is braced or bears on the other surface of the base body cavity 15. The surface 164 of the chuck wedge 16 directed radially outward is gently concave and forms the base of the chuck groove or slot 12. The chuck wedge 16 bearing on the front section 142 of the planing knife 14 resting in the longitudinal groove 13 with its clamping surface 161 is clamped against the base 152 in the base body cavity 15, whereby the chuck wedge 16 moves radially toward the outside and bears with its bearing surface 162 and the longitudinal rib 163 on the surfaces of the base body cavity 15 facing opposite to each other in the rotation direction and presses with its clamping surface 161 on the front section 142 of the planing knife 14. To produce this clamping force two threaded passages 26 spaced longitudinally from each other are provided in the chuck wedge 16. Respective clamping screws 27 are screwed in both threaded passages 26. These clamping screws 27 engage with their free screw ends on the base 152 of the base body cavity 15 (FIGS. 3 and 5). Both clamping screws 27 are provided with a hexagonal recess 28 and are completely screwed into the clamping wedge 16.

The chuck wedge 16 is axially slidable in the base body cavity to an extent limited by the outer cover sheets 182,183 both provided with the central hole 19. One cover sheet 182 is completely flat in the vicinity of the base body cavity and has only one cleaning slot 29 (FIG. 2). The other cover sheet 183 arranged on the other side of the base body 11 closes the packet of the shaped sheets 18 (FIGS. 3 and 4) and secures the planing knife 14 in order to prevent it from slipping out from the base body 11 when the planing head is idle. A chuck wedge window 30 in the cover sheet 183 is formed so that the chuck wedge 16 can then only pass axially through the chuck wedge window 30 when the wedge compression is completely eliminated and the chuck wedge 16 bears on the bottom 152 of the base body cavity 15. This disassembly position of the chuck wedge 16 is shown in FIG. 4. The chuck wedge 16 may then be removed with slight play through the chuck window 30.

Figure 14:
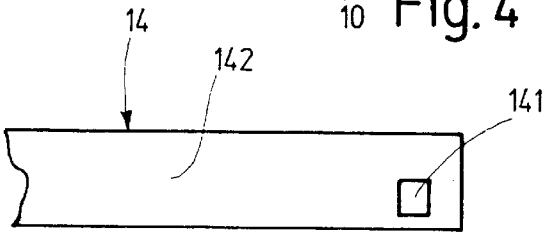
FIG. 14 is a cutaway plan view of a planing knife in the plane head according to FIGS. 1 to 5.
Figure 7:
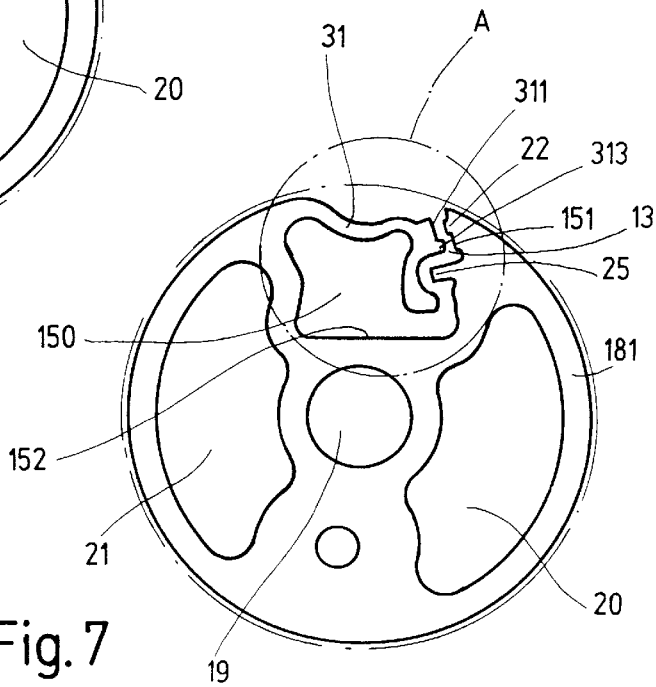
FIG. 7 is a plan view of an embodiment of a locking lamella with an integrated lock spring.
Figure 8:
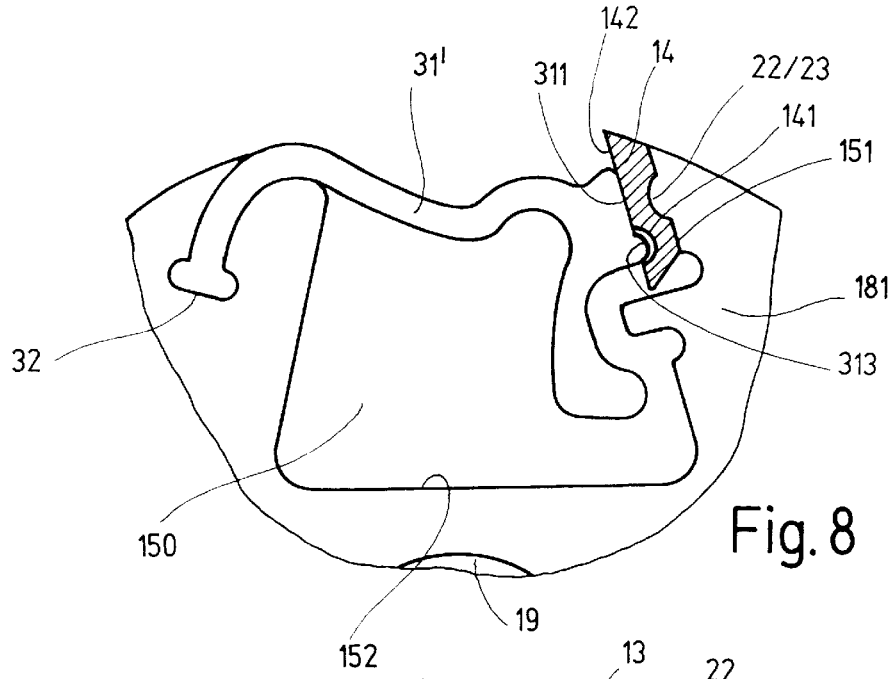
FIGS. 8 to 13 are respective detailed plan views of six additional embodiments of the locking sheets with associated lock spring.

A single locking sheet 181 (FIGS. 5 and 7) is arranged next to the cover sheet 183 between the stamped sheets 18. It is punched in one piece with a lock spring 31, which presses on a radially outer open side of the cavity 150. The lock spring 31 has a pressing side 311 (FIG. 7), which aligns with the clamping surface 161 of the chuck wedge 16 and bears on the knife front section 142 of the planing knife 14 under the spring force of the lock spring 31. A lock element 313 protrudes from the pressing side 311. This lock element 313 engages in a depression 141 stamped into the front section 142 of the planing knife 14 when the planing knife is inserted in the longitudinal groove 13 up to its ideal position (FIGS. 8 and 14). For knife exchange or replacement by means of an auxiliary tool the lock spring 31 is pushed so far that its lock element 313 moves out of the depression 141 and the planing knife 14 can be axially taken out of the longitudinal groove 13. When the depression is formed like a ball socket and the lock element 313 formed like a ball the locking can be released manually by a forced axial sliding of the planing knife, so that an auxiliary tool is not required.

A lock sheet 181 with different lock spring structures is shown in FIGS. 8 to 13. In all these embodiments the lock spring 31' is not in one piece with the lock sheet 181 as in FIG. 7 but is a separate piece which is fixed with its ends in a receiving groove 32 stamped in the lock sheet 181. The lock spring 31' is made from tempered spring steel, e.g. C 75, with a sheet thickness of e.g. 1 mm, laser cut or also fine punched or stamped. It has a substantially better spring behavior than the lock spring 31 according to FIG. 7 which is punched in one piece with the lock sheet 181. This is because the punched sheet 18 and the lock sheet 181 are usually stamped or punched made from plain steel sheet, e.g. St 1203, with a sheet thickness of e.g. 1.0 mm. Alternatively the lock spring 31' can also be made from a light metal, e.g. aluminum, or plastic according to the desired strength of the locking. The lock spring 31' has, as mentioned above, the pressing side 311 with the lock element 313, which forms the groove side of the longitudinal groove 13 receiving the planing knife in the vicinity of the lock sheet 181. As far as the additional embodiments for providing the receiving groove 32 for the lock spring 31' go, the lock sheets 181 according to FIGS. 8 to 13 have the same punched form as the lock sheet 181 according to FIG. 7, so that the same parts are provided with the same reference numbers in the drawing.

Figure 9:
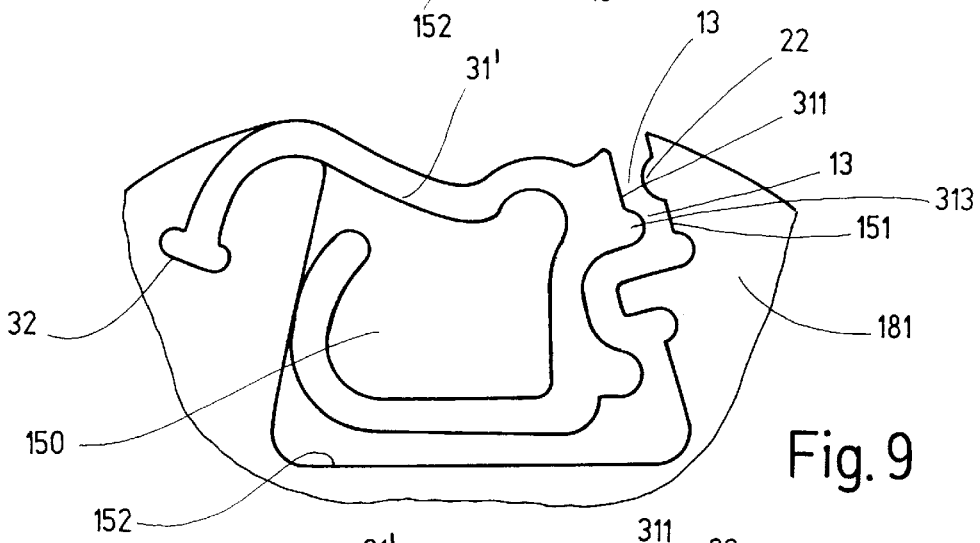
Figure 10:
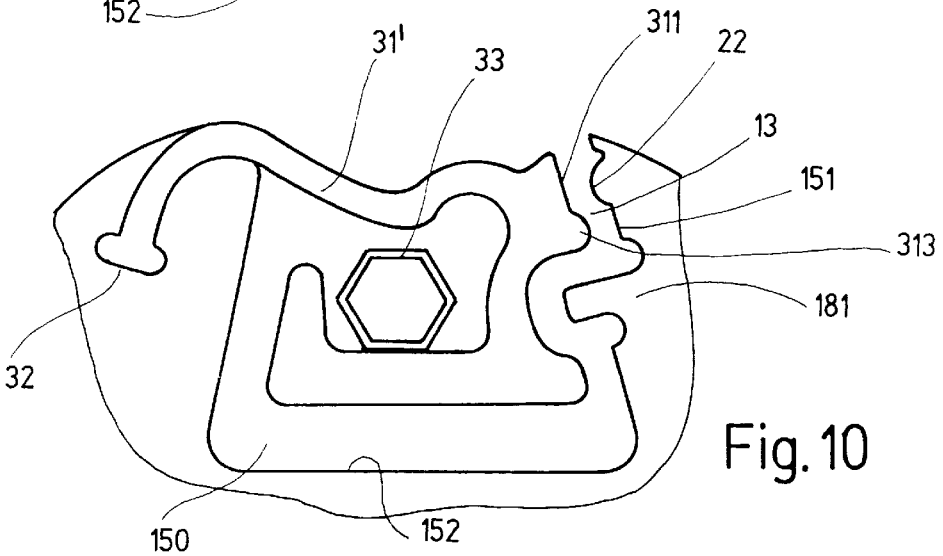

In the embodiments of FIGS. 8 to 10 the lock spring 31' is pressed at one spring end in a form-fitting connection in the receiving groove 32, and its other spring end is free. The latter spring end bears on the wedge-forming outwardly extending side surfaces of the base body cavity 15. These side surfaces are opposite the longitudinal groove 13 for receiving the planing knife 14 as seen in the rotation direction.

The locking force of the lock spring 31' on the planing knife 14 can be released as shown in FIG. 10. Here a socket wrench or a releasing key 33 is pushed through the chuck wedge window 30 and placed on the free spring end extending parallel to the bottom 152 of the cavity 15. When this spring end is moved in the direction of the bottom 152 by means of the socket wrench 33, the pressing side 311 releases the lock spring 31' from the planing knife. As a result the lock element 313 moves out of the depression 141 in the front section 142 of the planing knife 14 (FIG. 8).

Figure 11:
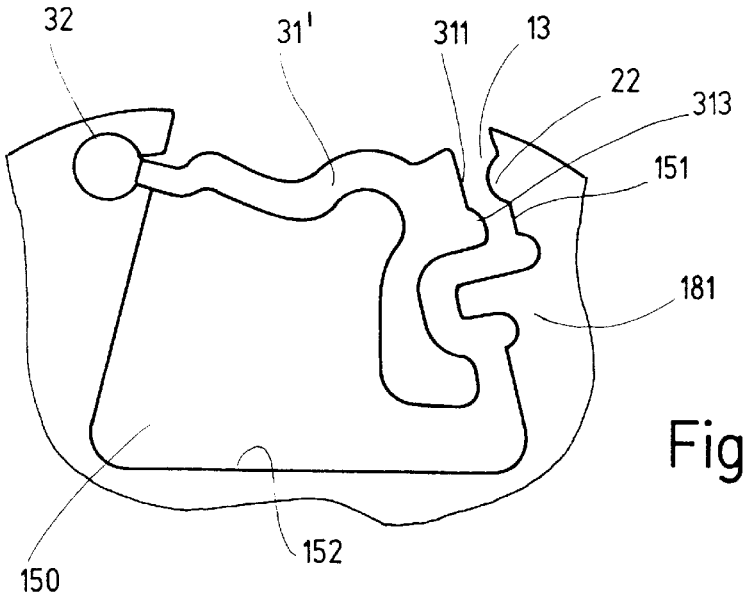

In the embodiment according to FIG. 11 the lock spring 31' is inserted in a circular groove 32, whereby it can be pivoted in the groove 32.

Figure 12:
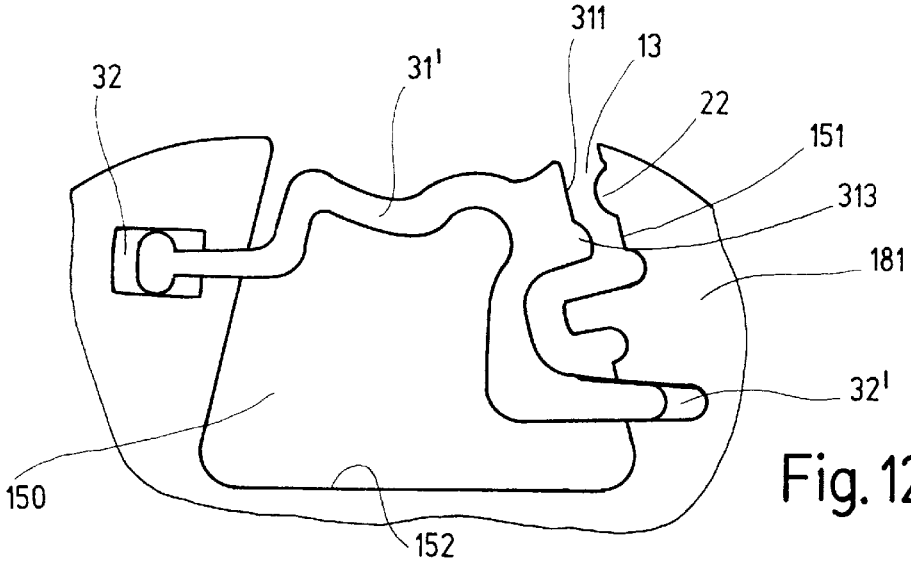
Figure 13:
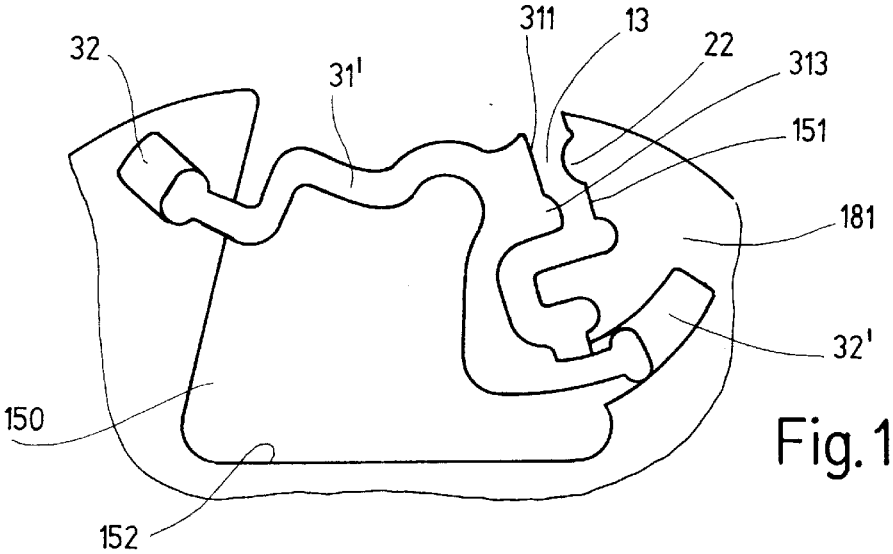

In both embodiments according to FIGS. 12 and 13 the ends of the lock spring 31' are received in longitudinal grooves 32 and 32' punched or stamped in the lock sheet 181 so that it is displaceable. Both longitudinal grooves 32 and 32' are straight in the embodiment of FIG. 12 and are curved in an arc shaped manner in the embodiment of FIG. 13, so that the lock spring 31' is linear in the embodiment according to FIG. 12 and nonlinear in the embodiment according to FIG. 13. In the embodiment of FIG. 13 it is inserted in both grooves 32 and 32'. Thus the width of the longitudinal groove 13 can be adjusted to receive the planing knife. In the respective desired positions the lock spring 31' is held in position in the longitudinal grooves 32,32' by means of a press fit.

In other embodiments it is possible to form the cover sheet 183 with the chuck wedge window 30 as a lock sheet. The cover sheet is then provided with a lock spring having a lock element, with which the planing knife 14 is secured in a definite position by engagement in a recess or hole 141 provided in the planing knife 14 (FIG. 14). The special lock sheet 181 between the stamped sheets 18 can then be dispensed with.

The disclosure in German Patent Application 198 35 725.7 of Aug. 7, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a plane head for a planing machine, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A plane head for a hand-held planing machine, said plane head comprising a cylindrical base body (11) including a plurality of stamped sheets (18) arranged axially next to each other and provided with at least one longitudinal groove (13), each of said stamped sheets (18) being provided with a punched hole (150) so as to form a base body cavity (15) in said base body (11);

a planing knife (14) protruding radially beyond an outer surface of the base body (11) from said at least one longitudinal groove (13) in the base body and fixed in the base body by a form-fitting connection device or form-locking connection device so that said planing knife cannot be radially dislodged from the base body; and at least one chuck wedge (16) received in said base body cavity (15) and arranged in said base body cavity (15) so that said planing knife (14) is clamped in the base body (11) by centrifugal force during rotation of the plane head;

wherein the at least one chuck wedge (16) is held releasably, radially movable, in the base body cavity (15), the base body cavity (15) and the at least one chuck wedge (16) are shaped to conform to each other so that the at least one chuck wedge bears with a clamping surface (161) on the planing knife (14), the at least one chuck wedge is braced on opposing surfaces of the base body cavity (15) facing opposite to each other in a rotation direction of the planing head and the at least one chuck wedge (16) is pressed against a bottom surface (152) of the base body cavity (15) to produce a spring force acting on the planing knife.

2. The plane head as defined in claim 1, wherein the at least one chuck wedge (16) has at least one radially extending threaded passage (26) and at least one clamping screw (27) engaged therein, and wherein each of said at least one clamping screws have a free end bearing on said bottom surface (152) of said base body cavity (15).

3. The plane head as defined in claim 1, further comprising a securing device for preventing loss of the at least one chuck wedge (16) from the base body cavity (15).

4. The plane head as defined in claim 3, wherein said securing device comprises an axially protruding catch element (25) extending into said base body cavity (15) and a catch groove (24) extending axially in the at least one chuck wedge (16), in which said catch element engages with radial play.

5. The plane head as defined in claim 1, wherein said opposing surfaces of said base body cavity (15) facing opposite to each other in said rotation direction point or taper toward each other in a radially outward-pointing direction from the base body (11) so that said base body cavity (15) has a wedge shape or trapezoidal shape, said clamping surface (161) is provided on a side of said at least one chuck wedge (16) adjacent to said planing knife and a convex longitudinal rib (163) is provided on said at least one chuck wedge (16) on another side thereof opposite to said side of said at least one chuck wedge, and the at least one chuck wedge (16) bears with a planar bearing surface (162) thereof on one of said opposing surfaces of said base body cavity (15) and with said convex longitudinal rib (163) on another of said opposing surfaces facing opposite to each other in said rotation direction.

6. The plane head as defined in claim 1, further comprising respective cover sheets (183,182) provided on opposite ends of said base body (11) and wherein said at least one chuck wedge (16) consists of a one-piece drawn steel section and is held axially slidably in said base body cavity (15) bounded by said cover sheets (181,182).

7. The plane head as defined in claim 6, wherein one of said cover sheets (182) is completely flat in the vicinity of the punched hole (150) in said stamped sheets (18) and another (183) of said cover sheets is provided with a chuck wedge window (30) in the vicinity of said punched hole (150), said chuck wedge window being formed so that said at least one chuck wedge (16) is only removable from the base body cavity when said at least one chuck wedge bears on the bottom surface (152) of the base body cavity (15).

8. The plane head as defined in claim 1, further comprising a lock sheet (181) with a lock spring (31) formed in one piece therewith arranged together with said sheets (18) in said base body (11) and said lock spring (31) has a pressing side (311) and a lock element (313) protruding from the pressing side, said lock spring bears with said pressing side (311) with a spring force on said planing knife (14) inserted in said at least one longitudinal groove (13), said lock spring engages with said lock element (313) in a depression (141) provided in a front section (142) of the planing knife.

9. A plane head for a hand-held planing machine, said plane head comprising a cylindrical base body (11) including a plurality of stamped sheets (18) arranged axially next to each other and provided with at least one longitudinal groove (13), each of said stamped sheets (18) being provided with a punched hole (150) so as to form a base body cavity (15) in said base body (11);

a planing knife (14) protruding radially beyond an outer surface of the base body (11) from said at least one longitudinal groove (13) in the base body and fixed in the base body by a form-fitting connection device or form-locking connection device so that said planing knife cannot be radially dislodged from the base body; and at least one chuck wedge (16) received in said base body cavity (15) and arranged in said base body cavity (15) so that said planing knife (14) is clamped in the base body (11) by centrifugal force during rotation of the plane head;

the at least one chuck wedge (16) is held releasably, radially movable, in the base body cavity (15), the base body cavity (15) and an the at least one chuck wedge (160 are shaped to conform to each other so that the at least one chuck wedge bears with a clamping surface (161) on the planing knife (14), the at least one chuck wedge is braced on opposite surfaces of the base body cavity (15) facing opposite to each other in a rotation direction of the planing head and the at least one chuck wedge (16) is pressed against a bottom surface (152) of the base body cavity (15) to produce a spring force acting on the planing knife;

a lock sheet (181) and a lock spring (31') separate from said lock sheet and arranged together with said stamped sheets 18) in said base body (11), and wherein said lock spring (31) has a pressing side (311) and a lock element (313) protruding from the pressing side, said lock spring bears with said pressing side (311) with a spring force on said planing knife (14) inserted in said at least one longitudinal groove (13), said lock spring engages with said lock element (313) in a depression (141) provided in a front section (142) of the planing knife, said lock spring (31') is made from spring steel, light metal or plastic and said lock spring (31') is held end-wise in at least one longitudinal slot (32) provided in said lock sheet (181).

10. The plane head as defined in claim 9, wherein said lock sheet (181) and said lock spring (31') are inserted together between one of said cover sheets (182,183) and one of said stamped sheets (18).

11. The plane head as defined in claim 9, wherein said at least one longitudinal slot (32) consists of a receiving groove and said lock spring (31') has two opposite ends, one of said opposite ends is held fixed or rotatable in said receiving groove and another of said opposite ends is free or bears on a side of a stamped hole provided in said lock sheet (181).

12. The plane head as defined in claim 9, wherein said at least one longitudinal slot (32) consists of two receiving grooves provided in respective opposite sides of a stamped hole provided in the lock sheet (181) and said lock spring (31') has two opposite ends, and said opposite ends of said lock spring are held longitudinally slidable in respective ones of said two receiving grooves in a press fit or a sliding seat.

* * * * *